US010214790B2

(12) United States Patent
Evertz et al.

(10) Patent No.: US 10,214,790 B2
(45) Date of Patent: Feb. 26, 2019

(54) METHOD FOR PRODUCING COMPONENTS FROM LIGHTWEIGHT STEEL

(71) Applicant: SALZGITTER FLACHSTAHL GMBH, Salzgitter (DE)

(72) Inventors: Thomas Evertz, Peine (DE); Manuel Otto, Cremlingen (DE); Bianca Springub, Hannover (DE); Zacharias Georgeou, Wolfsburg (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 550 days.

(21) Appl. No.: 14/889,391

(22) PCT Filed: May 6, 2013

(86) PCT No.: PCT/DE2013/000266
§ 371 (c)(1),
(2) Date: Nov. 5, 2015

(87) PCT Pub. No.: WO2014/180456
PCT Pub. Date: Nov. 13, 2014

(65) Prior Publication Data

US 2016/0122839 A1 May 5, 2016

(51) Int. Cl.
*C21D 6/04* (2006.01)
*C22C 38/02* (2006.01)
(Continued)

(52) U.S. Cl.
CPC ..... *C21D 6/04* (2013.01); *C21D 7/10* (2013.01); *C21D 9/0068* (2013.01); *C22C 38/02* (2013.01); *C22C 38/04* (2013.01); *C22C 38/06* (2013.01)

(58) Field of Classification Search
CPC ..... C21D 6/04; C21D 7/10; C21D 9/0068; C22C 38/02; C22C 38/04; C22C 38/06
See application file for complete search history.

(56) References Cited

U.S. PATENT DOCUMENTS 4,865,662 A 9/1989 Zimmer et al.
5,431,753 A * 7/1995 Kim ..... C21D 8/0205 148/620

(Continued)

FOREIGN PATENT DOCUMENTS

DE 199 00 199 A1 7/2000
DE 2004 061 284 A1 7/2005

(Continued)

OTHER PUBLICATIONS

English machine translation of DE 102009013631.*
International Search Report issued by the European Patent Office in International Application PCT/DE2013/000266.

*Primary Examiner* — Veronica F Faison
(74) *Attorney, Agent, or Firm* — Henry M. Feiereisen LLC

(57) ABSTRACT

A method is disclosed for producing components from an austenitic lightweight steel which is metastable in its initial state, by forming of a sheet, a circuit board or a pipe in one or more steps, exhibiting a temperature-dependent TRIP and/or TWIP effect during forming. To obtain a component with, in particular, high toughness, the forming is carried out at a temperature above room temperature, at 40 to 160° C., which avoids the TRIP/TWIP effect, and to achieve in particular high component strength, the forming is carried out at a temperature below room temperature, at −65 to 0° C., which enhances the TRIP/TWIP effect.

8 Claims, 1 Drawing Sheet

(51) Int. Cl.

| | |
|---|---|
| ***C22C 38/04*** | (2006.01) |
| ***C22C 38/06*** | (2006.01) |
| ***C21D 7/10*** | (2006.01) |
| ***C21D 9/00*** | (2006.01) |

(56) References Cited

U.S. PATENT DOCUMENTS

| | | | | |
|---|---|---|---|---|
| 8,404,061 | B2 | 3/2013 | Braun et al. | |
| 8,852,356 | B2 | 10/2014 | Spitzer et al. | |
| 2007/0289717 | A1* | 12/2007 | Kroos | B22D 11/045 164/462 |
| 2009/0010793 | A1* | 1/2009 | Becker | C21D 6/005 420/38 |
| 2009/0196785 | A1 | 8/2009 | Spitzer et al. | |
| 2009/0324441 | A1* | 12/2009 | Weiss | C21D 8/005 420/44 |
| 2010/0000634 | A1 | 1/2010 | Spehr et al. | |
| 2012/0121452 | A1 | 5/2012 | Spitzer et al. | |
| 2012/0305139 | A1 | 12/2012 | John et al. | |
| 2013/0048150 | A1* | 2/2013 | John | C21D 6/005 148/278 |
| 2013/0240520 | A1 | 9/2013 | Braun et al. | |

FOREIGN PATENT DOCUMENTS

| | | | |
|---|---|---|---|
| DE | 2009 013 631 | B8 | 8/2010 |
| EA | 2009 013 631 | B3 | 8/2010 |
| EP | 0 489 727 | B1 | 6/1992 |
| EP | 0 573 641 | B1 | 12/1993 |
| WO | WO 2013/124283 | A1 | 8/2013 |

* cited by examiner

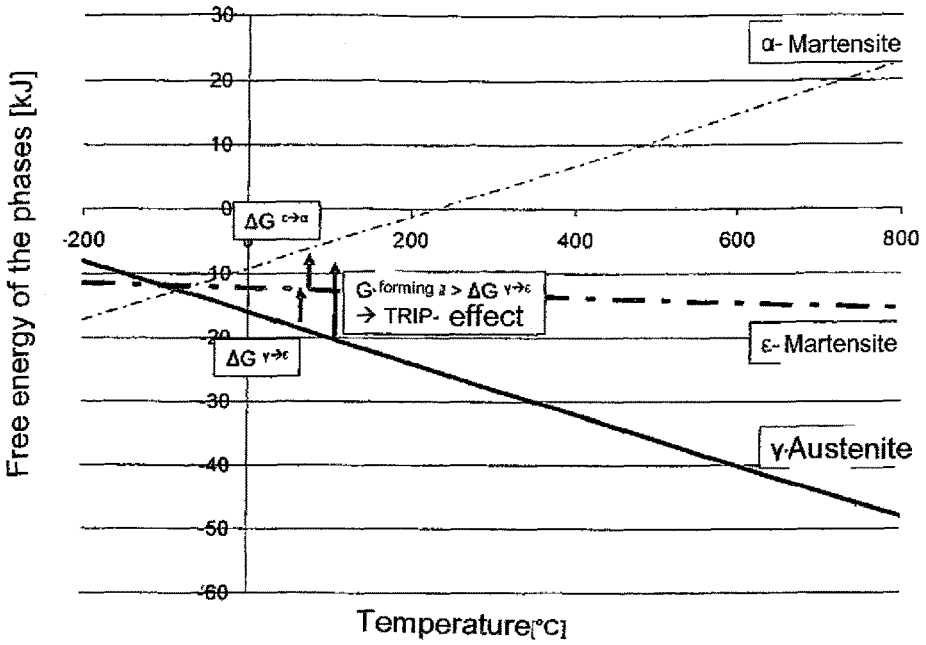
Free energy of the phases [kJ]
30
20
10
0
-10
-20
-30
-40
-50
-60
-200
200
400
600
800
Temperature[°C]
α- Martensite
ε- Martensite
γ-Austenite
ΔG ε→α
ΔG γ→ε
G-forming α > ΔG γ→ε
→ TRIP- effect

METHOD FOR PRODUCING COMPONENTS FROM LIGHTWEIGHT STEEL

CROSS-REFERENCES TO RELATED APPLICATIONS

This application is the U.S. National Stage of International Application No. PCT/DE20131000266 filed May 6, 2013, which designated the United States and has been published as International Publication No. WO 2014/180456, pursuant to 35 U.S.C. 119(a)-(d).

BACKGROUND OF THE INVENTION

The invention relates to a method for producing components from lightweight steel.

In the following the production of components is described, which were for example generated from strips, sheets or tubes by forming and which are for example used in the field of machine construction, plant construction and ship construction and in particular in vehicle construction for example for vehicle body parts and chassis parts.

Especially the hotly contested automobile market forces manufacturers to constantly seek solutions to lower fleet consumption while retaining highest possible comfort and occupant safety. In this regard on one hand weight saving of all vehicle components plays an important role but on the higher hand also properties of the individual components that promote the passive safety for passengers under conditions of high static and dynamic stress during operation and in the event of a crash.

Hereby the individual components have to meet very different requirements regarding strength, tenacity, wear resistance etc. An example for this are on one hand airbag mounts, which have to possess a very high tenacity in order to be able to absorb the energy introduced in the event of abrupt stress. On the other hand, for example in the case of transverse or longitudinal members of motor vehicles, high strengths have to be achieved also in regions that are formed to a lesser, wherein also a sufficiently high tenacity of the components has to be ensured.

In order to be able to achieve these sometimes contrary component properties, beside using classic austenitic chromium nickel steels new material concepts have been developed, which are optimally tailored to the respective demands placed on the component. These include for example duplex or multiphase steels, air-hardened steels or recently high-manganese-content austenitic lightweight steels.

A disadvantage is however that alloy concepts, which are adapted to the respective demands and are oftentimes expensive, have to be used for producing the components. Until now it has not been possible to satisfy different demands with only one material. In lightweight steels significant progress has been made in recent years. These steels are characterized by a low specific weight while at the same time having a high strength and tenacity with a high ductility, which makes them very interesting for vehicle construction (for example EP 0 489 727 B1, EP 0 573 641' B1, DE 199 00199 A1).

In these steels, which are austenitic in the starting state, the high proportion of alloy components with a specific weight far below the specific weight of iron (Mn, Si, Al) achieves a weight reduction, which is advantageous for vehicle construction, while at the same time retaining the usual construction.

From DE 10 2004 061 284 A1 for example a lightweight steel is known with an alloy composition (in weight %):

| | | |
|---|---|---|
| C | 0.04 | up to 1.0 |
| Al | 0.05 | up to <4.0 |
| Si | 0.05 | up to 6.0 |
| Mn | 9.0 | up to <18.0 |

remainder iron including usual steel accompanying elements. Optionally depending on the requirements Cr, Cu, Ti, Zr, V and Nb can be added.

This known lightweight steel has a partially stabilized mixed-crystal microstructure with defined stacking fault energy with a partially multiple TRIP effect, which the tension or stretch induced transformation of a face-centered mixed crystal (austenite into a martensite (hexagonal highest density spherical packing) which then during further deformation transforms into a body-centered martensite and residual austenite. The high degree of deformation is achieved by TRIP (Transformation Induced Plasticity) and TWIP (Twinning Induced Plasticity) properties of the steel.

Numerous tests have shown that the carbon content is of paramount importance in the complex interaction between Al, Si and Mn. On one hand it increases the stacking fault energy and on the other hand expands the metastable austenite region. As a result the deformation-induced martensite formation and the associated hardening and also the ductility can be influenced over broad ranges.

With these lightweight steels many customer demands can already be satisfied to the most degree, however, there is still the desire to produce stress-optimized components made of lightweight steel with smallest possible alloy costs and at the same time satisfying different demands corresponding to the expected stress during operation regarding strength, tenacity, wear-resistance etc. However, this demand can currently only be met by steels having alloy compositions that are adapted to the respective demands and is therefore associated with increased manufacturing costs.

SUMMARY OF THE INVENTION

It is an object of the invention to provide a method for producing components from metastable austenitic lightweight steel with TRIP and TWIP properties with which it is possible to produce components in a simple and cost-effective manner by using a single material with which different demands during operation can be met.

This object is solved with the preamble and the characterizing features of the independent method claim.

According to the teaching of the invention, for achieving an in particular high tenacity of the component the forming is performed at a temperature above room temperature, at 40 to 160° C. which avoids the TRIP-/TWIP effect, and for achieving in particular a high component strength the forming is performed at a temperature below room temperature at −65 to 0° C. that enhances the TRIP-/TVVIP effect.

In the following, the term room temperature means a temperature range from 19 C to 27° C.

The basic idea of the invention is that he required forming temperatures are set in a targeted manner in correspondence to the demands placed on the component. Hereby the temperature dependence of the hardening mechanism in metastable austenitic lightweight steels, which have a TRIP-/TVVIP effect, is utilized. Consequently it is now possible to use a single material for producing components with different material properties which, corresponding to the demands, are produced with different forming temperatures.

According to the invention the sheets, plates or tubes used for the components can be metallically blank or provided with a metallic coating.

From the state of the art it is known that the TRIP effect is based on the difference between the energies of the individual phases. When the forming temperature exceeds the difference of the energies, the microstructure correspondingly transforms. In the case of a metastable austenite the γ phase at room temperature is the stable phase, however, it has a very low energy difference with regard to the α or ε phase (Figure).

By using different temperatures during forming the TRIP effect can thus be enhanced at low temperatures, because the energy that has to be overcome is low. When the forming is performed at temperatures above room temperature, the austenite is stabilized because the energy that has to be overcome strongly increases.

For example, the temperature increase occurring in the component during the forming can be used in a targeted manner. Hereby, starting from room temperature, the temperature of the component increases to about 40 to 160° C. While the tools usually have to be cooled during manufacturing in order to prevent an influencing the material properties of the component, in the instant case according to the invention cooling is not performed or the tools are set to a temperature of 40 to 16° C. in a targeted manner. In this way components are produced which have a stable austenitic microstructure with high ductility.

This process can be used for example for producing crash relevant components such as airbag mounts which, due to the increased tenacity, can absorb a much higher amount of energy in the event of an abrupt stress than components that were produced at room temperature.

On the other hand when the material is for example formed between −65 to 0° C., an increased TRIP effect occurs. In particular it was found that a significantly higher yield strength of the component is achieved than when forming with higher temperatures.

BRIEF DESCRIPTION OF THE DRAWING

Correspondingly, this process is relevant for components that (also locally) undergo a small degree of forming and with this solid state hardening, and at the same time require a high strength in the regions that are formed to a small degree, such as cross members or longitudinal members.

For achieving a high tenacity of the component during operation, the forming into a component should therefore occur at temperatures of about 40-160° C., and for achieving a high strength of the component between about −65 and 0° C.

With this innovative manufacturing method the cost-disadvantages of the state of the art can be overcome in a simple manner. In particular for example no expensive highly alloyed austenitic CrNi materials are needed when components with extremely high tenacity are required. On the other hand, this manufacturing method also enables producing components, which have a very high strength and high tenacity during operation, which is not possible with the known material concepts.

On one hand, the high forming capability of austenitic materials without additionally adding alloy elements can be optimized by suppressing the TRIP- or TWIP effect in the first forming steps, and thus retaining the forming capability of the basic material prior to the last forming step. On the other hand, the TRIP- or TWIP effect can be enhanced by forming at low temperature. Thus the strength of the component can be increased even without addition of further alloy elements.

For example in the first step or in a further step the forming can occur at a temperature above room temperature, which avoids the deformation-induced TRIP-/TWIP effect, in order to retain the ductility of the starting material, and in the subsequent step the forming can occur at a temperature below room temperature which enhances the TRIP-/TWIP effect, in order to produce a component with high strength.

DETAILED DESCRIPTION OF PREFERRED EMBODIMENTS

Possible forming methods for producing the components are for example different rolling methods, deep drawing or also the forming by means of internal high pressure.

In addition, the method according to the invention enables producing components, which have to be subjected to extreme forming degrees. This is achieved by suppressing the TRIP-/TWIP effect at elevated forming temperatures.

According to an advantageous refinement of the invention, the forming is performed in multiple stages, wherein in the individual stages the forming temperature and/or the degree of forming and/or the forming speed can be varied. This enables providing the component with very different material characteristics in the different forming stages, which offers many possibilities to meet many different demands placed on the component.

Hereby it is not only possible to impinge the entire component with the corresponding forming temperature but also to form the component with partially different temperatures, so that even different material properties within one component can be realized.

The invention claimed is:

1. A method for producing a steel component from an austenitic lightweight steel which is metastable in its initial state and exhibits a temperature-dependent TRIP and/or TWIP effect during forming, comprising:

providing a sheet, plate or tube made of the metastable austenitic light lightweight steel;

forming the sheet, plate or tube in one or more steps in at least one of two ways, a first way in which the sheet, plate or tube is formed at a forming temperature above room temperature at 40 to 160° C. so as to avoid the TRIP-/TWIP effect, resulting in a high tenacity of the steel component, and a second way in which the forming is performed at a forming temperature below room temperature at −65-0° C., so as to enhance the TRIP-/TWIP effect resulting in a high strength of the steel component.

2. The method of claim 1, wherein the forming is a rolling.

3. The method of claim 1, wherein the forming is a deep drawing.

4. The method of claim 1, wherein the forming is an internal high pressure forming (IHU).

5. The method of claim 1, wherein the forming is performed in multiple steps, the method further comprising varying the forming temperature and/or a degree of forming and/or a forming speed between individual ones of the multiple steps.

6. The method of claim 5, wherein in a first one of the multiple steps or in a further one of the multiple steps subsequent to the first step, the forming is performed above room temperature, and wherein in a final one of the multiple steps the forming is performed at a temperature below room temperature.

7. Components made from an austenitic, metastable lightweight steel which is metastable in its initial state and exhibits a temperature-dependent TRIP and/or TWIP effect during forming, said components being produced by forming a sheet, plate or tube made of the metastable austenitic lightweight steel in one or more steps in at least one of two ways, a first way in which the sheet, plate or tube is formed at a forming temperature above room temperature at 40 to 160° C. so as to avoid the TRIP-/TWIP effect, resulting in a high tenacity of the steel component, and a second way in which the forming is performed at a forming temperature below room temperature at −65-0° C., so as to enhance the TRIP-/TWIP effect resulting in a high strength of the steel component, wherein the components have a metallic coating.

8. The components of claim 7, wherein the sheet plate or tube used in the forming has a metallic coating.

* * * * *